US009597727B2

(12) United States Patent
Kim et al.

(10) Patent No.: US 9,597,727 B2
(45) Date of Patent: Mar. 21, 2017

(54) WATER COOLING APPARATUS FOR CENTRIFUGAL CASTING EQUIPMENT

(71) Applicant: HYUNDAI MOTOR COMPANY, Seoul (KR)

(72) Inventors: Young Chan Kim, Hwaseong-si (KR); Jun Min Lee, Hwaseong-si (KR); Min Soo Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/923,386

(22) Filed: Oct. 26, 2015

(65) Prior Publication Data

US 2016/0332224 A1 Nov. 17, 2016

(30) Foreign Application Priority Data

May 14, 2015 (KR) ..... 10-2015-0067241

(51) Int. Cl.
*B22D 13/10* (2006.01)

(52) U.S. Cl.
CPC ..... *B22D 13/105* (2013.01); *B22D 13/104* (2013.01)

(58) Field of Classification Search
CPC ..... B22D 13/105
USPC ..... 164/118, 297
See application file for complete search history.

(56) References Cited

U.S. PATENT DOCUMENTS 4,561,486 A * 12/1985 Maeda ..... C30B 11/00 117/924
5,626,179 A * 5/1997 Choudhury ..... B22C 9/061 106/38.27

FOREIGN PATENT DOCUMENTS

| | | | |
|---|---|---|---|
| JP | H05-169220 | A | 7/1993 |
| JP | H06-007894 | A | 1/1994 |
| JP | H06-190508 | A | 7/1994 |
| KR | 20-1999-0010256 | U | 3/1999 |
| KR | 20-0246445 | | 10/2001 |
| KR | 10-2002-0037429 | | 5/2002 |
| KR | 10-2003-0038977 | | 5/2003 |

* cited by examiner

*Primary Examiner* — Kevin E Yoon
(74) *Attorney, Agent, or Firm* — Brinks Gilson & Lione

(57) ABSTRACT

A water cooling apparatus for cooling centrifugal casting equipment that includes an upper mold and a lower mold rotating together includes a rotating shaft in which a first cooling passage is formed and to which a nozzle is provided at an end portion of the rotating shaft, and a collecting portion which surrounds a side surface of the lower mold and is installed apart from the lower mold. The lower mold is connected to the rotating shaft and includes a chamber separated from a mold space formed between the upper and lower molds in order to store cooling water injected to the nozzle. The lower mold includes at least one second cooling passage extended from the chamber toward an outer circumference surface direction, and the collecting portion receives the cooling water discharged through the second cooling passage.

10 Claims, 7 Drawing Sheets

WATER COOLING APPARATUS FOR CENTRIFUGAL CASTING EQUIPMENT

CROSS-REFERENCE TO RELATED APPLICATION

This application claims the benefit of Korean Patent Application No. 10-2015-0067241, filed on May 14, 2015, which is hereby incorporated by reference in its entirety.

FIELD

The present disclosure relates to a water cooling apparatus for centrifugal casting equipment.

BACKGROUND

The statements in this section merely provide background information related to the present disclosure and may not constitute prior art.

Centrifugal casting refers to a method forming casting by using centrifugal force generated when rotating a mold at a high speed during injecting and then coagulating molten metal. In order to cast via the centrifugal casting method, it needs to inject the molten metal into the mold rapidly and uniformly so that the molten metal can be coagulated from the surface contacted with the mold toward the inside thereof, whereby high-quality casting products without internal defects can be obtained. For this, the rotating speed of the mold, the injecting temperature and the injecting speed of the molten metal should be uniformly maintained. Further, if the mold is not sufficiently preheated, the molten metal is immediately coagulated the moment it is injected into the mold such that air bubbles inside the molten metal are coagulated with collected state, thereby causing internal quality problems.

In the case of continuously casting the high-temperature (660~750°) molten metal such as aluminum, since the temperature of the mold rises consistently, the coagulation is delayed or local heat isolation is generated depending on the products shapes, and therefore there has been the problem that casting defects (air bubble defect, contraction defect) are generated inside the casting products. In order to solve this problem, the mold should be cooled during the casting process. However, since the mold rotates at 300~3,000 rpm for the centrifugal casting, it is difficult to apply the circulation type cooling apparatus using cooling water.

The conventional mold cooling method not using the cooling water has used the processes of cooling the mold by insufflating cool air into the inside of the mold or by injecting cool air to the surface of the mold in a state of stopping casting works. However, there have been the problems that the casting process should be stopped in order to cool the inside of the mold and the method cooling the surface of the mold has the low cooling efficiency.

The conventional mold cooling method using cooling water is concretely well-known as "A blank casting apparatus for stainless steel pipe flange (Korean Patent Publication No. 10-2002-0037429 (May 21, 2002)).

Technology exists that cools a mold by supplying cooling water to cooling jacket formed at the lower surface wall of the rotating mold for casting a pipe. This circulation type cooling system, in which a cooling water inflow pipe and a cooling water outflow pipe are installed inside a hollow shaft, is applied such that the cooling water is supplied to the cooling jacket through the hollow shaft and then discharged through the hollow shaft again. If the rotating mold rotates, the phenomenon that cooling water is heeled over toward the outer circumference surface direction of the cooling jacket by centrifugal force occurs. As described above, if the cooling water is congested outside, there has been the problem that the cooling water is heated such that the cooling efficiency of the mold is reduced and the cooling water flowed through the cooling water inflow pipe is directly flowed out through the cooling water outflow pipe.

Because of these problems, it may be possible to change the shape of the cooling jacket from a chamber shape to a pipe shape. Even in this case, however, the problem that the cooling water is isolated and congested at a variation portion formed at the pipe has been generated. In order to solve this, a high pressure pump more than 300 bar for further increasing the cooling water supply pressure has been required.

SUMMARY

The present disclosure provides a water cooling apparatus for centrifugal casting equipment capable of improving the cooling efficiency of a mold.

An exemplary form of the present disclosure is directed to a water cooling apparatus for centrifugal casting equipment that casts by injecting molten metal into the mold space formed between an upper mold and a lower mold which rotate with coupled to each other, which may include a rotating shaft in which a first cooling passage is formed and to which a nozzle is provided at an end portion thereof; the lower mold being connected to the rotating shaft, and the lower mold including a chamber formed with separated from the mold space in order to store cooling water injected at the nozzle and at least one second cooling passage formed to be extended from the chamber toward an outer circumference surface direction; and a collecting portion surrounding a side surface of the lower mold and being installed apart from the lower mold and collecting the cooling water discharged toward the side surface of the lower mold through the second cooling passage.

An outlet of the second cooling passage formed at the side surface of the lower mold may be positioned higher than the nozzle.

The surface of the chamber opposite the nozzle at a central line of the lower mold may be concavely formed; and the second cooling passage may comprise an inlet formed at a lower side surface of the chamber; a raising portion connected with the inlet and upwardly bent in the outer circumference surface direction of the lower mold; and a cooling portion connected with the raising portion and formed horizontally in the outlet direction.

The outlet may be formed to be protruded outwardly through the side surface of the lower mold.

The rotating shaft may include a core that the first cooling passage is formed in an axial direction therein, an injecting hose is connected to an one end portion thereof and the nozzle is connected to the other end thereof; and a case of a pipe shape surrounding the core; and the core may be connected with the case via a bearing such that the core is fixed and the case is able to rotate independently.

The nozzle may have a diameter larger than the diameter of the core in order to close a gap between the core and the case.

The collecting portion may include a main body of a ring shape surrounding the peripheral portion of the lower mold; a filter receiving and purifying the cooling water collected in the main body; and a pump injecting the cooling water passed through the filter into the first cooling passage again;

and a collecting groove receiving the cooling water may be formed at an inner circumference surface of the main body opposite the lower mold.

The main body may be installed downwardly slantly at one side thereof and a drain port may be formed at a lower portion of the one side; and the main body may include a discharging hose delivering the cooling water discharged from the drain port to the filter and an injecting hose delivering the cooling water passed through the filter and the pump to the first cooling passage.

The water cooling apparatus for centrifugal casting equipment according to the present disclosure may have the following effects.

Firstly, the cooling water can be supplied at a relatively low pressure as the outlet is not formed at the rotating shaft but formed at the side surface of the mold.

Secondly, the cooling efficiency can be enhanced as the new cooling water is rapidly supplied since the cooling water is discharged out of the mold at a fast speed by centrifugal force.

Thirdly, the cooling efficiency can be higher than the external cooling method as the inside of the mold is directly cooled.

Fourthly, the structure can be refined and the physical properties can be improved as the casting is rapidly cooled and uniformly coagulated.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
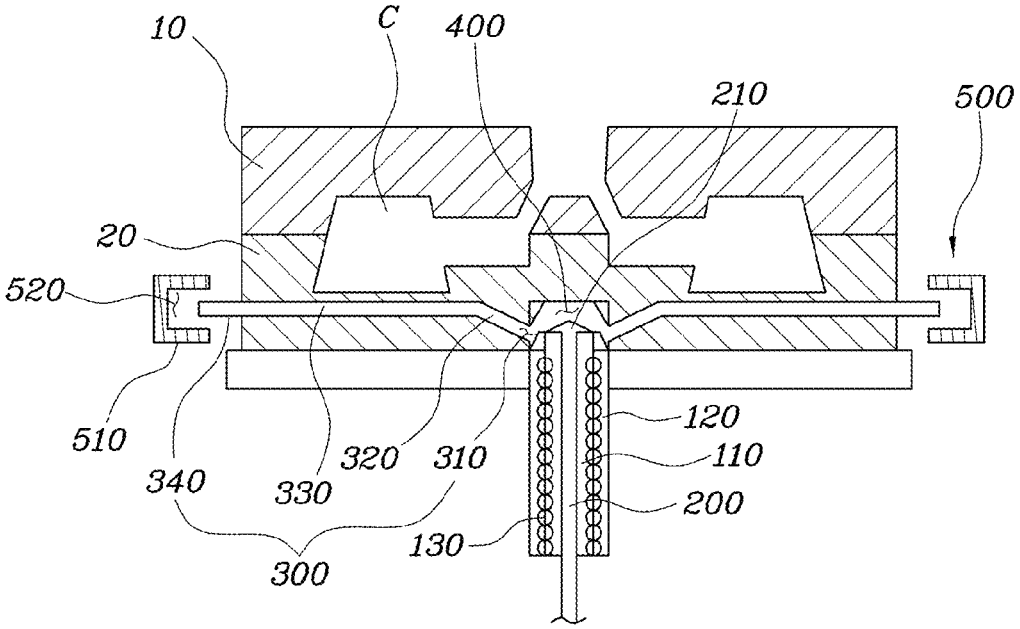
FIG. 1 is a cross sectional view of a water cooling apparatus for centrifugal casting equipment according to one form of the present disclosure.

The drawings described herein are for illustration purposed only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The terminologies used herein are used just to illustrate a specific exemplary form, but are not intended to limit the present disclosure. It must be noted that, as used in the specification and the appended claims, the singular forms include plural references unless the context clearly dictates otherwise. It will be further understood that the terms "comprises", when used in this specification, specify the presence of stated properties, regions, integers, steps, operations, elements, and/or components, but do not preclude the presence or addition of one or more other properties, regions, integers, steps, operations, elements, components, and/or groups.

Unless differently defined, all terms including technical terms and scientific terms used herein have the same meanings as those generally understood by a person with ordinary skill in the art to which the present disclosure pertains. The terminologies that are defined in a generally used dictionary are further understood to have meanings that coincide with related technical documents and contents that are currently disclosed, but are not to be interpreted as idealized or very formal meaning unless defined.

Figure 2:
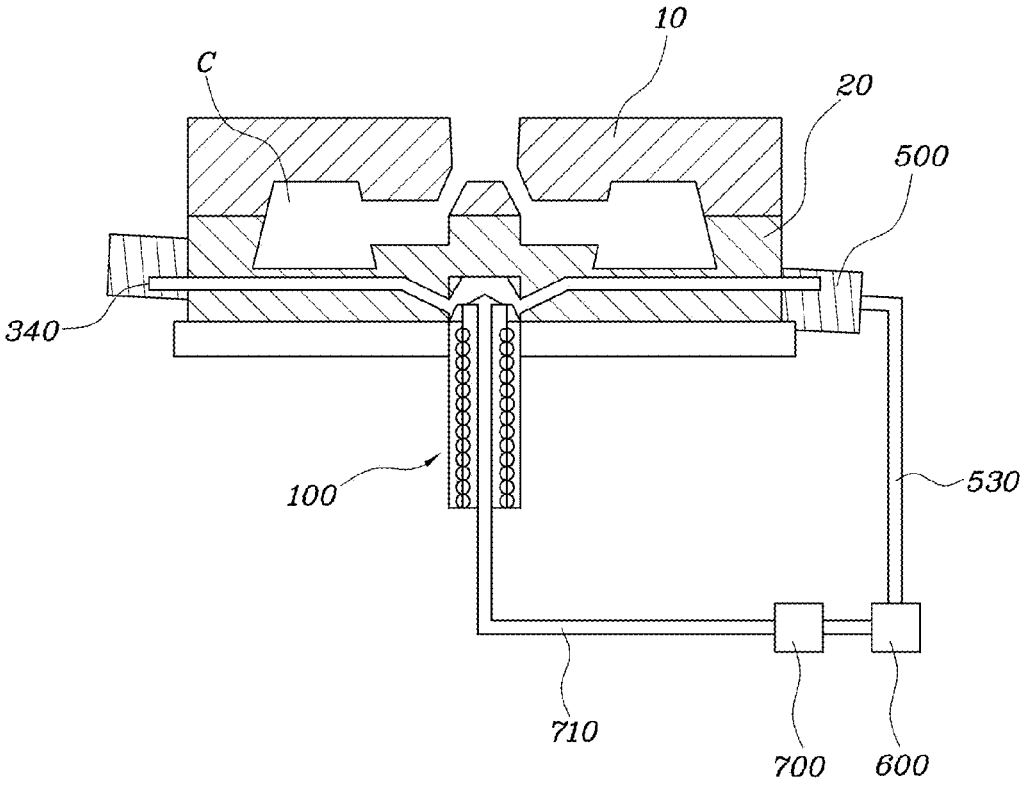
FIG. 2 is a view showing total cooling water circulation structure of the water cooling apparatus for centrifugal casting equipment.

As shown in FIGS. 1 and 2, in order to cool a centrifugal casting equipment that casts by injecting molten metal into the mold space C formed between an upper mold 10 and a lower mold 20 which rotate with coupled to each other, the water cooling apparatus for centrifugal casting equipment may include a rotating shaft 100 in which a first cooling passage 200 for supplying cooling water is formed, the lower mold 20 connected with the rotating shaft 100 to be rotated together and formed with a second cooling passage 300 therein to discharge the cooling water laterally, and a collecting potion 500 for collecting the cooling water discharged toward a side surface of the lower mold 20.

The rotating shaft 100 may be divided into two parts, which are a core 110 having the first cooling passage 200 formed in an axial direction therein and a case 120 surrounding the core 110 and rotating with the lower mold 20. The core 110 and the case 120 may be connected with each other via a bearing 130 such that the core 110 can maintain a fixed state without rotating even if the case 120 rotates. So the core 110 is fixed, whereby the connecting portion with an injecting hose 710 described hereafter is not twisted.

The ends of the core 110 and the case 120 may be inserted into a chamber 400 formed at the lower mold 20. The chamber 400 may be a space of the concave groove shape formed at an axial line of the lower mold 20. A constant space may be formed in the inside of the chamber 400 by closing an inlet of the concave groove via the core 110 and the rotating shaft 100. The chamber 400 may be separately formed with respect to a mold space C in which casting is manufactured and serve to prevent the casting from being directly connected with the cooling water.

Furthermore, a nozzle 210 may be formed at the end of the core 110 to inject the cooling water into the chamber 400. In one form, the diameter of the outer circumference surface in the nozzle 210 is larger than that of core 110, which is to prevent the cooling water from being flowed backward through a gap between the core 110 and the case 120 by closing the gap via the nozzle 210.

The second cooling passage 300 may be formed at the inside of the lower mold 20 to induce the cooling water toward the side surface of the lower mold 20 from the chamber 400. The second cooling passage 300 may include an inlet 310, a raising portion 320 and a cooling portion 330. The inlet 310 of the second cooling passage 300 may be formed at the lower portion of the chamber 400, that is, the side surface of the direction into which the rotating shaft 100 is inserted. The cooling water entered into the second cooling passage 300 through the inlet 310 may pass through the raising portion 320 formed upwardly at a predetermined angle, and then may be discharged to the outside of the lower mold 20 through the cooling portion 330 connected to the raising portion 320 and formed to be extended to the outside of the lower mold 20. Since the raising portion 320 is formed to be bent upwardly at a predetermined angle, an outlet 340 formed at the outer end portion of the cooling portion 330 can be located higher than the nozzle 210. By forming the outlet 340 to be located higher than the nozzle 210, it is possible to temporarily store the cooling water discharged from the nozzle 210 to the chamber 400 and to supply the cooling water more smoothly when the mold starts to rotate.

In another form, the outlet 340 is extended outwardly beyond the outside surface of the lower mold 20 at a predetermined length, which is to prevent the cooling water from being scattered while discharged and assist that the cooling water is collected through the collecting portion 500.

Figure 3:
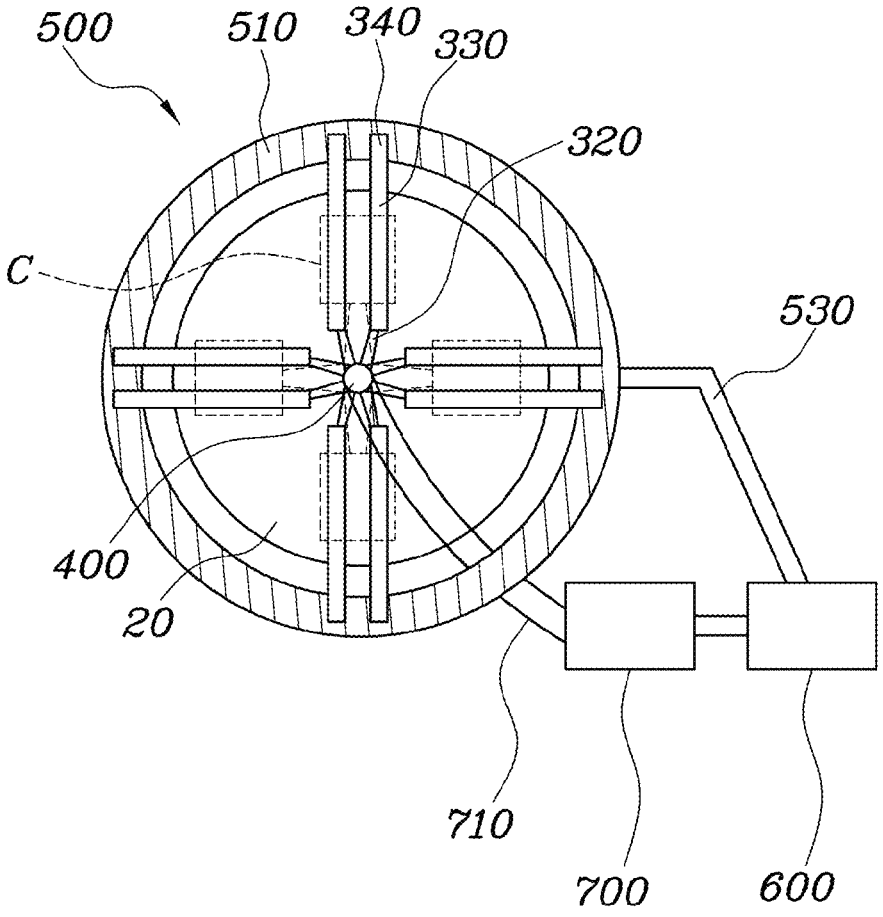
FIG. 3 is a top plan view of a collecting portion and the cooling water circulation structure.

As shown in FIGS. 1 and 3, the collecting portion 500 may include a main body 510 of a ring shape surrounding the peripheral portion of the lower mold 20, a filter 600 receiving and purifying the cooling water collected in the main body 510, and a pump 700 injecting the cooling water passed through the filter 600 into the first cooling passage 200 again. In another form, a collecting groove 520 for receiving the cooling water may be formed on the inner circumference surface of the main body 510.

In still another form, the one side portion of the main body 510 may be slantly installed downwardly and a drain port may be formed at the lower portion of the one side portion so that the cooling water discharged through the drain port can be transmitted to the filter 600 through a discharging hose 530. The cooling water purified at the filter 600 is again supplied to the first cooling passage 200 through an injecting hose 710 by the pump 700. Although not shown, a water tank may be installed between the filter 600 and the pump 700, which is configuration for receiving cooling water from the outside in order to replenish the cooling water consumed while circulated.

Hereinafter, the physical properties improvement of casting manufactured by an exemplary form of the present disclosure will be described with reference to FIGS. 4 to 7.

Figure 4:
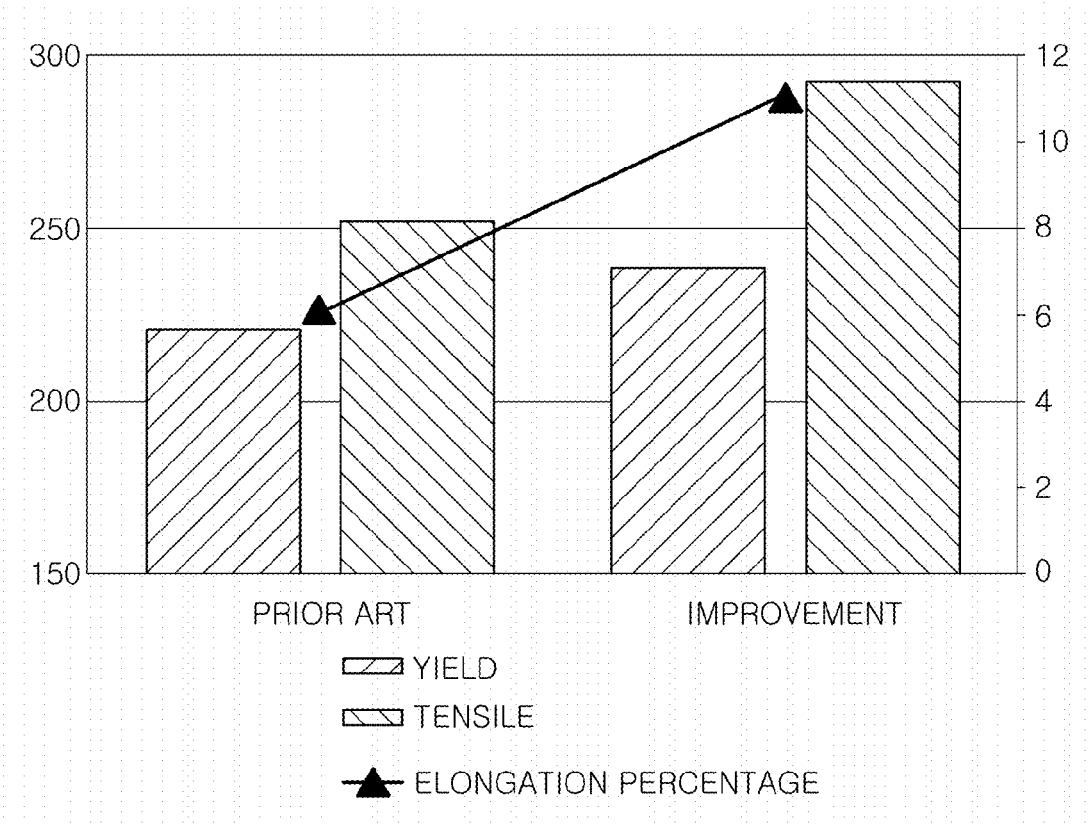
FIG. 4 is a graph comparing the physical properties of the casting manufactured by the prior art with the casting manufactured by applying the present disclosure.
Figure 5:
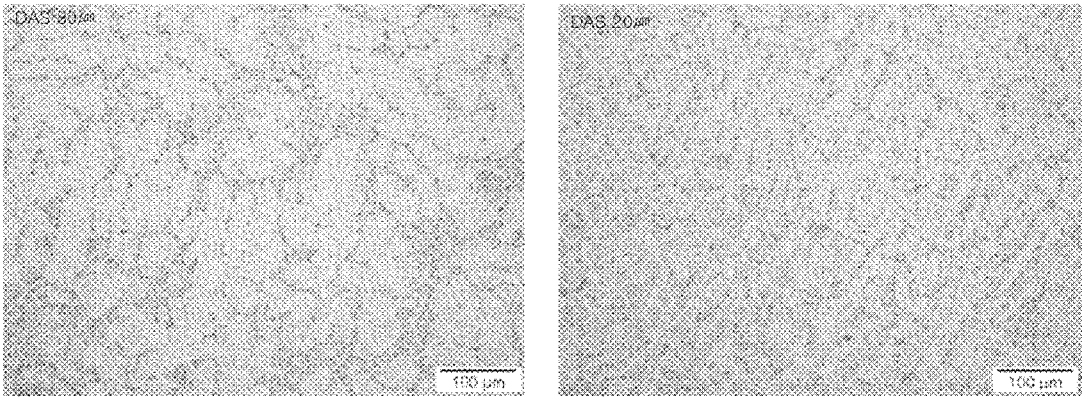
FIG. 5 is a picture comparing the structures of the casting manufactured by the prior art with the casting manufactured by applying the present disclosure.

FIGS. 4 and 5 show the difference of physical properties and fine structure by a cooling speed of aluminum alloy (A356) including Si 7%. In the product manufactured by using conventional cooling method, since the cooling is incomplete, the size of aluminum a-phase becomes coarse and DAS (Dendrite Arm Spacing) shows 30 μm in the fine structure of a portion where a surface temperature is high relatively (refer to the left side of FIG. 5). However, in the event that the casting is cooled by the water cooling apparatus according to an exemplary form of the present disclosure, it can know that the size of the structure in the same portion is fine and evenly distributed. Also, it can know that the structure according to present disclosure is dense compared to the conventional product as the DAS is 20 μm (refer to the right side of FIG. 5).

Figure 6:
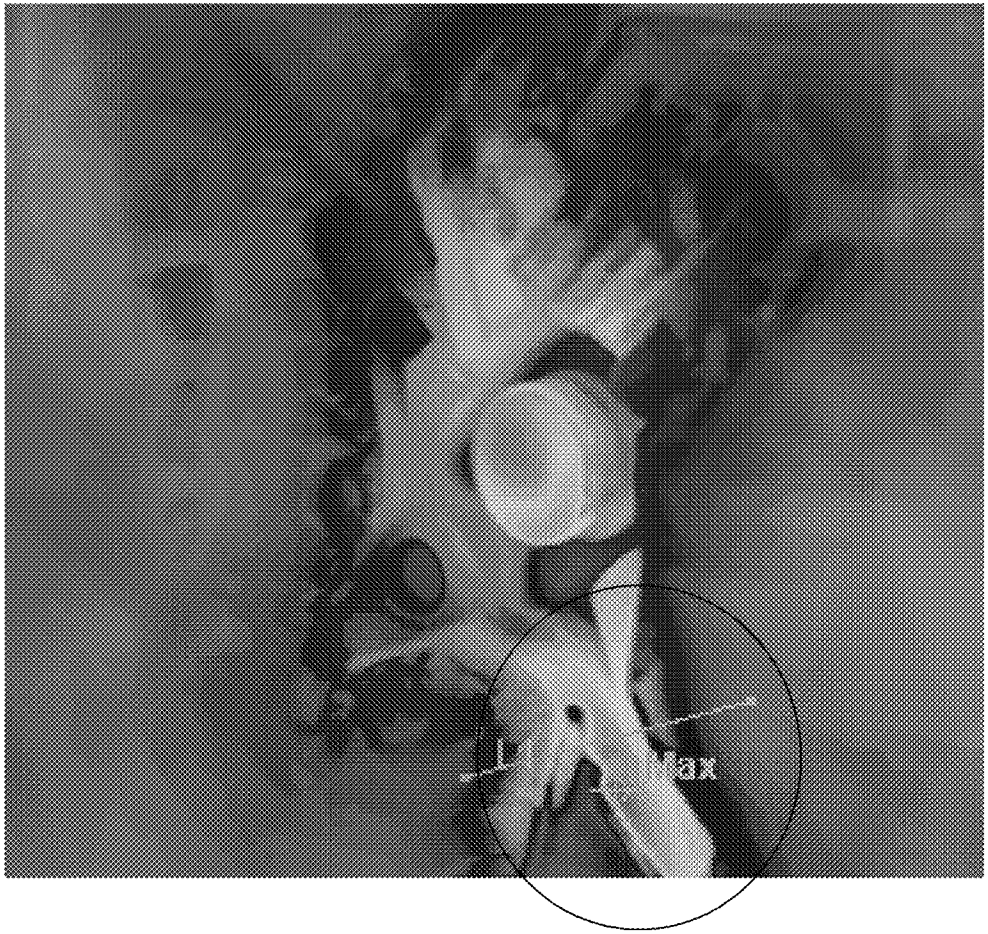
FIG. 6 is a thermal image picture indicating the temperature during the casting manufactured by the prior art is coagulated.
Figure 7:
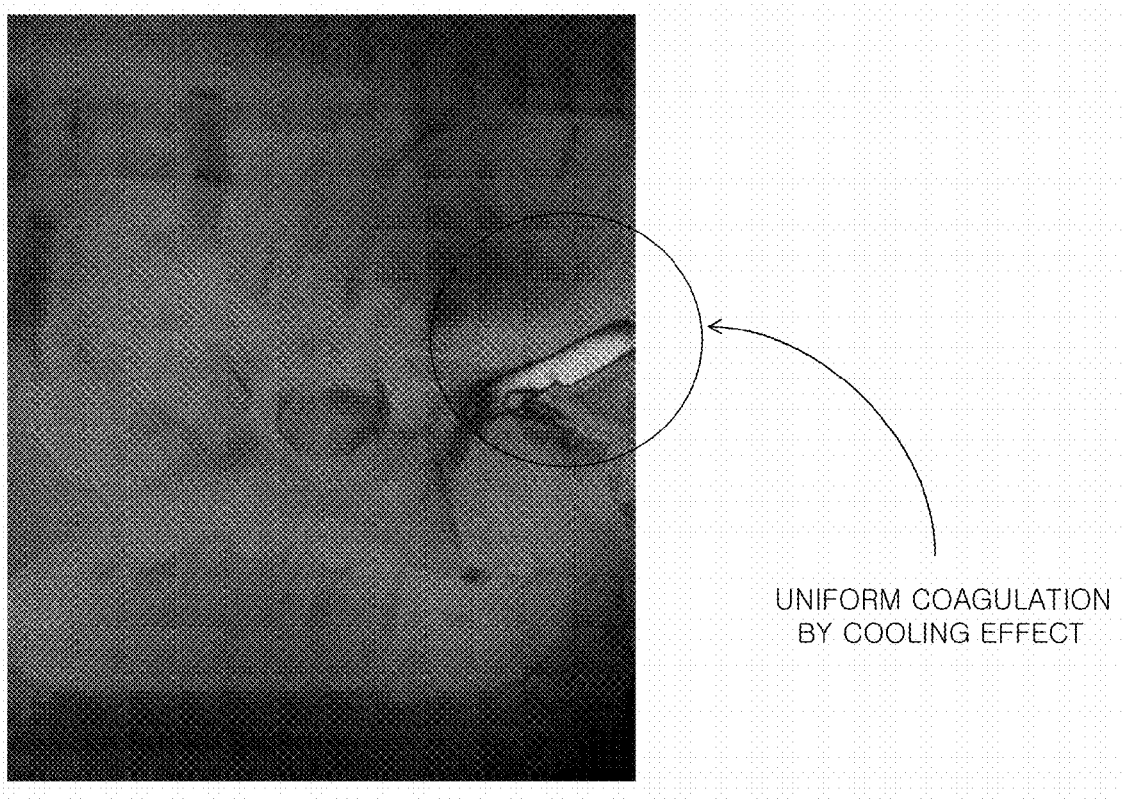
FIG. 7 is a thermal image picture indicating the temperature during the casting manufactured by the exemplary form of the present disclosure is coagulated.

FIGS. 6 and 7 show thermal image pictures indicating the temperatures during the castings are cooled and coagulated by the cooling method according to the prior art and the cooling method according to an exemplary form of the present disclosure, respectively.

FIG. 6 shows that the temperature-raising portion (inside of the circle) is relatively widespread and the temperature difference is great, whereas FIG. 7 shows that the range of the temperature-raising portion (inside of the circle) is relatively narrow and the temperature difference is small.

The size difference of the structure, the range of the temperature-raising portion and the degree of the temperature difference cause differences of physical properties. The casting manufactured by the conventional method represents yield strength of 221 MPa, tensile strength of 252 MPa and elongation percentage of 6.2%, whereas the casting manufactured by an exemplary form of the present disclosure represents yield strength of 239 MPa, tensile strength of 293 MPa and elongation percentage of 11.1%. Each of the yield strength, the tensile strength and the elongation percentage is improved about 8%, 16% and 79%. This represents that the physical properties of the casting manufactured by using the cooling method according to an exemplary form of the present disclosure is much better than that of the casting manufactured by using the cooling method according to a prior art.

As described above, the exemplary forms of the present disclosure have been described and illustrated in the drawings and the specification. However, a person having ordinary skill in the art to which the present disclosure pertains will understand that the present disclosure may be implemented by the other concrete forms without changing the technical ideas or the essential characteristics thereof.

What is claimed is:

1. A water cooling apparatus for cooling centrifugal casting equipment including an upper mold and a lower mold rotating together, said water cooling apparatus comprising:

a rotating shaft in which a first cooling passage is formed, and a nozzle provided at an end portion of the rotating shaft, the lower mold being connected to the rotating shaft, and including a chamber configured to store a cooling water injected from the nozzle and at least one second cooling passage extended from the chamber toward an outer circumference surface direction of the lower mold, the chamber separated from a mold space formed between the upper and lower molds; and a collecting portion spaced apart from and surrounding a side surface of the lower mold, and the collection portion configured to collect the cooling water discharged toward the side surface of the lower mold through the second cooling passage.

2. The water cooling apparatus of claim 1, wherein an outlet of the second cooling passage formed on the side surface of the lower mold is positioned higher than the nozzle.

3. The water cooling apparatus of claim 2, wherein a surface of the chamber opposite the nozzle at a central line of the lower mold is concavely formed; and the second cooling passage comprises:

an inlet formed at a lower side surface of the chamber;

a raising portion connected with the inlet and upwardly bent in the outer circumference surface direction of the lower mold; and a cooling portion connecting the raising portion to the outlet of the second cooling passage to pass the cooling water from the inlet to the outlet.

4. The water cooling apparatus of claim 3, wherein the outlet is extended outwardly beyond the side surface of the lower mold to collect the cooling water by the collecting portion.

5. The water cooling apparatus of claim 1, wherein the rotating shaft comprises:

a core comprising the first cooling passage formed in an axial direction thereof; and a case surrounding the core, the core connected with the case via a bearing such that the core is fixed while the case is configured to rotate independently.

6. The water cooling apparatus according to claim 5, further comprising an injecting hose configured to connect the core to the nozzle to supply the cooling water.

7. The water cooling apparatus of claim 5, wherein the nozzle has a diameter larger than the diameter of the core to close a gap between the core and the case.

8. The water cooling apparatus of claim 1, wherein the collecting portion comprises:

a main body surrounding the side surface of the lower mold; and a collecting groove formed on an inner circumference surface of the main body and configured to receive the cooling water.

9. The water cooling apparatus according to claim 8, wherein the collecting portion further comprises:

a filter configured to receive and purify the cooling water collected in the main body; and a pump configured to inject the cooling water passed through the filter into the cooling passage of the shaft.

10. The water cooling apparatus of claim 8, wherein one side portion of the main body is slantly installed downwardly around the lower mold and a drain port is formed in a lower part of the side portion of the main body; and a discharging hose is configured to deliver the cooling water discharged from the drain port to the filter and an injecting hose delivering the cooling water passed through the filter to the cooling passage of the shaft.

* * * * *